US006136106A

United States Patent [19]

Commandeur et al.

[11] Patent Number: 6,136,106

[45] Date of Patent: Oct. 24, 2000

[54] PROCESS FOR MANUFACTURING THIN PIPES

[75] Inventors: Bernhard Commandeur, Wülfrath; Rolf Schattevoy, Wuppertal; Klaus Hummert, Coesfeld, all of Germany

[73] Assignee: Erbsloh Aktiengesellschaft, Velbert, Germany

[21] Appl. No.: 09/029,767

[22] PCT Filed: Aug. 28, 1996

[86] PCT No.: PCT/EP96/03780

§ 371 Date: Feb. 27, 1998

§ 102(e) Date: Feb. 27, 1998

[87] PCT Pub. No.: WO97/09459

PCT Pub. Date: Mar. 13, 1997

[30] Foreign Application Priority Data

Sep. 1, 1995 [DE] Germany ..... 195 32 252

[51] Int. Cl.[7] ..... C21C 8/10

[52] U.S. Cl. ..... 148/519; 148/523; 148/689; 148/690; 148/691; 148/694; 427/456

[58] Field of Search ..... 148/523, 519, 148/552, 689–698; 427/456

[56] References Cited

U.S. PATENT DOCUMENTS

| | | |
|---|---|---|
| 3,325,279 | 6/1967 | Lawrence et al. . |
| 4,155,756 | 5/1979 | Perrot et al. . |

FOREIGN PATENT DOCUMENTS

| | | |
|---|---|---|
| 0112848 | 5/1986 | European Pat. Off. . |
| 0196145 | 10/1986 | European Pat. Off. . |
| 0191707 | 9/1988 | European Pat. Off. . |
| 0341714 | 11/1989 | European Pat. Off. . |
| 0100470 | 5/1990 | European Pat. Off. . |
| 0366134 | 5/1990 | European Pat. Off. . |
| 0411577 | 2/1991 | European Pat. Off. . |
| 0529520 | 3/1993 | European Pat. Off. . |
| 0367229 | 1/1994 | European Pat. Off. . |
| 0589137 | 3/1994 | European Pat. Off. . |
| 0592665 | 4/1994 | European Pat. Off. . |
| 0363225 | 6/1994 | European Pat. Off. . |
| 0635318 | 6/1994 | European Pat. Off. . |
| 0746633 | 12/1994 | European Pat. Off. . |
| 0670441 | 9/1995 | European Pat. Off. . |
| 0672760 | 9/1995 | European Pat. Off. . |
| 0704613 | 4/1996 | European Pat. Off. . |
| 0710729 | 5/1996 | European Pat. Off. . |
| 0466120 | 10/1996 | European Pat. Off. . |
| 0526079 | 11/1996 | European Pat. Off. . |
| 0529993 | 1/1997 | European Pat. Off. . |
| 0600474 | 1/1997 | European Pat. Off. . |
| 0788413 | 2/1997 | European Pat. Off. . |
| 0558957 | 5/1997 | European Pat. Off. . |
| 0777043 | 6/1997 | European Pat. Off. . |
| 0577436 | 12/1997 | European Pat. Off. . |
| 0669404 | 6/1998 | European Pat. Off. . |
| 810223 | 8/1951 | Germany . |
| 2333198 | 1/1974 | Germany . |
| 2252139 | 9/1976 | Germany . |
| 2709844 | 9/1977 | Germany . |
| 2418389 | 10/1977 | Germany . |
| 3434110 | 5/1985 | Germany . |
| 3435460 | 4/1986 | Germany . |
| 4020268 | 8/1991 | Germany . |
| 4111509 | 10/1992 | Germany . |
| 4212716 | 10/1993 | Germany . |
| 4244502 | 3/1994 | Germany . |
| 4230228 | 5/1994 | Germany . |
| 19518552 | 11/1995 | Germany . |
| 4418750 | 11/1995 | Germany . |
| 19610055 | 4/1997 | Germany . |
| 4427795 | 4/1997 | Germany . |
| 19604793 | 7/1997 | Germany . |
| 19605946 | 7/1997 | Germany . |
| 4404420 | 7/1997 | Germany . |
| 4328093 | 4/1998 | Germany . |
| 6211395 | 7/1988 | Japan . |
| 6211396 | 7/1988 | Japan . |
| 6330263 | 11/1994 | Japan . |
| 665223 | 4/1988 | Switzerland . |
| 8703012 | 5/1987 | WIPO . |

OTHER PUBLICATIONS

"Feinung der SI–Primärphase übereutektischer AlSi–Gusslegierungen" by W. Schneider et al., published in "Alluminium 68", 1992, pp. 1064–1070.

"Leigierungen auf Al–Si–Basis—Bandbreite, Möglichkeiten, Grenzen" by G. Huppert et al., published in "Metall 49", No. 3, 1995, pp. 187–190.

"Aluminium im Automobilbau" by E. Köhler, published in "Galvanotechnik 85", No. 9, 1994, pp. 2885–2893.

Chemical Abstract vol. 98 #20, May 16, 1983. Abstract #165644, XP002021916.

*Primary Examiner*—Deborah Yee

*Attorney, Agent, or Firm*—Horst M. Kasper

[57] ABSTRACT

The invention relates to a method for manufacturing thin-walled pipes, which are made of a heat-resistant and wear-resistant aluminum-based material. The method comprises the spray-compacting of a thick-walled pipe made of a hypereutectic aluminum-silicon AlSi material, possibly a subsequent overaging annealing, and the hot deformation to a thin-walled pipe. Such a method is in particular united for the production of cylinder liners of internal combustion engines, since the produced liners exhibit the required properties in regard to wear resistance, heat resistance and reduction of pollutant emission.

20 Claims, No Drawings

PROCESS FOR MANUFACTURING THIN PIPES

The invention relates to a method for manufacturing thin-walled pipes, which pipes are made of a heat-resistant and wear-resistant aluminum-based material, in particular for use as cylinder liners for internal combustion engines.

Cylinder liners are components subject to wear, which are inserted, pressed or cast into the cylinder openings of the crankcase of the internal combustion engine.

The cylinder faces of an internal combustion engine are subjected to high frictional loads from the pistons or, respectively, from the piston rings and to locally occurring high temperatures. It is therefore necessary that these faces be made of wear-resistant and heat-resistant materials.

In order to achieve this goal, there are numerous processes amongst others to provide the face of the cylinder bore with wear-resistant coatings. Another possibility is to dispose a cylinder liner made of a wear-resistant material in the cylinder. Thus, gray-cast-iron cylinder liners were used, amongst others, which liners however exhibit a low heat conductivity as compared to aluminum-based materials and exhibit other disadvantages.

The problem was first solved with a cast cylinder block made of a hypereutectic aluminum-silicon AlSi alloy. The silicon content is limited to a maximum of 20 weight-percent for reasons associated with casting technology. As a further disadvantage of the casting method it is to be mentioned that primary silicon particles of relatively large dimensions (about 30–80 $\mu$m) are precipitated during the solidification of the melt. Based on the size and their angular and sharp-edged form, the primary silicon Si particles lead to wear at the piston and piston rings. One is therefore forced to protect the pistons and the piston rings with corresponding protective layers/coatings. The contact face of the silicon Si particles to the piston/piston ring is flat-smoothed through mechanical machining treatment. An electrochemical treatment then follows to such a mechanical treatment, whereby the aluminum matrix is slightly reset between the silicon Si grains such that the silicon Si grains protrude insignificantly as support structure from the cylinder face. The disadvantage of thus manufactured cylinder barrels lies, on the one hand, in a substantial manufacturing expenditure (costly alloy, expensive mechanical machining treatment, iron-coated pistons, armored and reinforced piston rings) and, on the other hand, in the defective distribution of the primary silicon Si particles. Thus, there are large areas in the microstructure which are free of silicon Si particles and thus are subject to an increased wear. In order to prevent this wear, a relatively thick oil film is required as separation medium between barrel and friction partner. The clearing depth of the silicon Si particles is amongst others decisive for the setting of the oil-film thickness. A relatively thick oil film leads to higher friction losses in the machine and to a larger increase of the pollutant emission.

In comparison, a cylinder block according to the DE 42 30 228, which is cast of an below-eutectic aluminum-silicon AlSi alloy and is provided with liners of a hypereutectic aluminum-silicon AlSi alloy material is more cost advantageous. However, the aforementioned problems are also not solved in this case.

In order to employ the advantages of the hypereutectic aluminum-silicon AlSi alloys as a liner material, the microstructure in regard to the silicon grains is to be changed. As is known, aluminum alloys, which cannot be realized using casting technology, can be custom-produced by powder-metallurgic processes or spray compacting.

Thus, in this way hypereutectic aluminum silicon AlSi alloys are produceable which have a very good wear resistance and receive the required heat resistance through alloying elements such, as for example iron Fe, nickel Ni, or manganese Mn, based on the high silicon content, the fineness of the silicon particles, and the homogeneous distribution. The primary silicon particles present in these alloys have a size of about 0.5 to 20 $\mu$m. Therefore, the alloys produced in this way are suited for a liner material.

Even though aluminum alloys are in general easy to be processed, the deformation of these hypereutectic alloys is more problematic. A method for producing liners from a hypereutectic aluminum-silicon alloy is known from the German printed patent document EP 0 635 318. According to this reference, the liner is produced by extrusion presses at very high pressures and extrusion rates of 0.5 to 12 m/min. Very high extrusion rates are required in order to produce cost-effectively the liners to a final dimension with extruders. It has been shown that the high extrusion rates lead to a tearing of the profile during extrusion in case of such difficultly extrudable alloys and of the small wall thicknesses of the liners to be achieved.

The spray-compacting of hollow cylinders, the so-called tube blanks, is known from the WO 87/03012. For example, the manufacture of tube blanks having wall thicknesses of 25 to 40 mm is described. The same above-described problems occur upon deformation of such tube blanks to thin-walled pipes, for example, by extrusion.

The object of the invention is therefore to provide for an improved and much more cost-advantageous method for manufacturing thin-walled pipes, in particular for cylinder liners of internal combustion engines, wherein the finished liners are to exhibit the required property improvements in regard to wear resistance, heat resistance, and reduction of the pollutant emission.

According to the invention, the object is solved by a method with the method steps recited in patent claim 1.

Additional embodiments of the invention are given in the sub-claims.

The required tribological properties are in particular achieved in that silicon particles are present in the material as primary precipitates in a size range of from. 0.5 to 20 $\mu$m, or as added and admixed particles in a size range of up to 80 $\mu$m. Methods have to be employed for the manufacture of such aluminum Al alloys which allow a substantially higher solidification rate of a high-alloy melt than it is possible with conventional casting processes.

On the one hand, the spray compacting method (in the following referred to as "spray compacting") belongs to this. An aluminum alloy melt, highly alloyed with silicon, is atomized and cooled in the nitrogen stream at a cooling rate of 1000° C./s. The in part still liquid powder particles are sprayed onto a support pipe, rotating horizontally around the longitudinal axis and made of the same type of material or a conventional aluminum material (for example, $AlMgSi_{0.5}$). The support pipe, which has preferably wall thicknesses of from 2 to 3 mm, is linearly shifted under the spray beam during the process. By superpositioning the rotation motion and the translation motion of the support pipe, there is generated a cylindrical pipe having a fixed predetermined inner diameter. The outer diameter results from the charging speed and from the effective compacting rate. Pipes having wall thicknesses of from 6 to 20 mm can be manufactured in this way. A quasi continuous production operation can be achieved with suitable feed and guiding systems for the support pipes.

Primary silicon Si precipitates having a size of up to 20 $\mu$m are generated in this spray-compacting process based on the high cooling speeds. An adaptation of the silicon Si precipitate size is achieved with the "gas to metal ratio" (standard cubic meter of gas per kilogram of melt), with which the solidification speed can be set in the process. Silicon Si contents of the alloys of up to 40 weight-% can be realized based on the high solidification speeds and the supersaturation of the melt. The supersaturation state in the resulting billet is quasi "frozen" based on the fast quenching of the aluminum melt in the gas stream.

The spray compacting process in addition offers the possibility to enter particles with a particle injector into the billets or into the tube blanks, which particles were not present in the melt. There exists a plurality of adjustment possibilities for a microstructure since these particles can exhibit any desired geometry and any desired size between 2 $\mu$m and 400 $\mu$m. These particles can be, for example, silicon Si particles in the range of from 2 $\mu$m to 400 $\mu$m or oxide-ceramic particles (for example, $Al_2O_3$) or non-oxide-ceramic particles (for example, SiC, $B_4C$, etc.) in the aforementioned particle-size spectrum, as they are commercially available and sensible for the tribological aspect.

The microstructural condition of the spray-compacted pipe can be changed with subsequent overaging annealing processes. The microstructure can be set with an annealing to a silicon grain size of from 2 to 30 $\mu$m as it is desired for the required tribological properties. The growing of larger silicon Si particles during the annealing process is effected by diffusion in the solid at the expense of smaller silicon particles. This diffusion is dependent on the averaging and annealing temperature and the duration of the annealing treatment. The higher the temperature is chosen, the faster the silicon Si grains grow. Suitable temperatures are at about 500° C., wherein an annealing duration of 3 to 5 hours is sufficient.

The thereby resulting and therefore custom-made microstructure no longer changes in the subsequent processing steps or it changes in the sense of the required tribological properties.

A reduction of the wall thickness to the required final dimensions is achieved by hot deformation by means of various processes dependent on the starting wall thickness of the such manufactured pipes. The process temperatures are between 300° C. and 550° C. In this case, the hot deformation serves not only for the forming, but also to the closing of the process-caused residual porosity (1–5%) in the spray-compacted starting material.

The pipe, formed to the final wall thickness, is subsequently cut into pipe sections of the required length.

The invention method has the advantage that the material for the liner can be custom-made. At the same time, the high expenditure in the case of one-step extruding of thin-walled pipes, both in regard to extrusion pressure and extrusion rate, as well as product quality and production economy, is successfully avoided based on the described method of production.

EXAMPLE 1

An alloy of the composition AlSi25Cu2.5Mg1Nil is compacted to a pipe having a wall thickness of 15.0 mm at a melt temperature of 830° C. with a gas/metal ratio of 4.5 $m^3$/kg (standard cubic meter gas per kilogram of melt) by spray-compacting on a support pipe (inner diameter: 69.5 mm, wall thickness: 2.0 mm) at a charging speed of about 0.6 m/min. Th silicon Si precipitates in the size range of from 1 $\mu$m to 10 $\mu$m are present under the recited conditions in the spray-compacted-material. The spray-compacted pipe is subjected to an annealing treatment of four hours at 520° C. The silicon Si precipitates are in the size range of from 2 $\mu$m to 30 $\mu$m after this annealing treatment. The spray-compacted pipe is formed by subsequent hot deformation by swaging at 420° C. from an outer diameter of 98 mm to an outer diameter of 79 mm and an inner diameter of 69 mm, wherein the inner diameter is formed by a mandrel. The degree of deformation is sufficient to completely close the aforementioned residual porosity in the spray-compacted pipe. No other change in microstructure occurs during swaging.

We claim:

1. A method for manufacturing liners for internal combustion engines made of an aluminum alloy with a hypereutectic amount of silicon in the aluminum alloy comprising the steps of spray compacting the aluminum alloy with a hypereutectic amount of silicon in the aluminum alloy melt onto a rotating support pipe such that there is generated directly a thick-walled pipe of a wall thickness of from 6 to 20 mm of the aluminum alloy material with the hypereutectic amount of silicon in the aluminum alloy material, wherein contained primary silicon particles have a size of from about 0.5 to 20 $\mu$m;

reducing said thick-walled pipe by a hot-deformation process at temperatures of from 250 to 500° C. to a wall thickness of 1.5 to 5 mm.

2. The method according to claim 1, wherein the contained primary silicon particles have a size of from 1 to 10 $\mu$m.

3. The method according to claim 1, further comprising annealing said thick-walled pipe in case of need for coarsening the contained primary silicon particles to overage them for growing the primary silicon particles to a size of from about 2 to 30 $\mu$m.

4. The method according to claim 1, wherein the alloy melt of the following composition:

from about 17 to 35 weight percent silicon, from about 2.5 to 3.5 weight percent copper, from about 0.2 to 2 weight percent magnesium, from about 0.5 to 2 weight percent nickel, and wherein the balance of the alloy is aluminum.

5. The method according to claim 1, wherein the alloy melt of the following composition is employed for manufacturing the pipe:

from about 17 to 35 weight percent silicon, from about 3.0 to 5.0 weight percent iron, from about 1.0 to 2.0 weight percent nickel, and wherein the remaining balance of the alloy is aluminum.

6. The method according to claim 1, wherein the alloy melt of the following composition is employed for manufacturing the pipe:

from about 25 to 35 weight percent silicon, and wherein the balance of the alloy is aluminum.

7. The method according to claim 1, wherein the alloy melt of the following composition is employed for manufacturing the pipe:

from about 17 to 35 weight percent silicon, from about 2.5 to 3.3 weight percent copper, from about 0.2 to 2 weight percent magnesium, from about 0.5 to 5 weight percent manganese, and wherein the balance of the alloy is aluminum.

8. The method according to claim 1, further comprising melting an aluminum alloy with from about 5 to 15 weight percent of silicon for obtaining an alloy melt:

spray compacting the alloy melt; and furnishing an additional part of the silicon in the form of silicon powder by means of a particle injector into the pipe during spray compacting to obtain a pipe made of an aluminum alloy with a hypereutectic amount of silicon in the aluminum alloy.

9. The method according to claim 1, further comprising furnishing in addition wear-resistant oxide-ceramic particles with a particle injector during spray-compacting.

10. The method according to claim 1, further comprising furnishing in addition wear-resistant non-oxide-ceramic particles with a particle injector during spray-compacting.

11. The method according to claim 1, further comprising performing the hot-deformation process of the thick-walled pipe by round kneading and swaging or rotary swaging.

12. The method according to claim 1, further comprising performing the hot-deformation process of the thick-walled pipe by tube rolling with an internal tool.

13. The method according to claim 1, further comprising performing the hot-deformation process of the thick-walled pipe by press rolling.

14. The method according to claim 1, further comprising performing the hot-deformation process of the thick-walled pipe by tube drawing.

15. The method according to claim 1, further comprising performing the hot-deformation process of the thick-walled pipe by annular rolling.

16. The method according to claim 1, further comprising performing the hot-deformation process of the thick-walled pipe by hollow—forward—extrusion molding and hollow—backward—extrusion molding, respectively.

17. The method according to claim 1, further comprising cutting the pipe into pipe sections of a desired length after having been formed in diameter and in wall thickness to a final dimension.

18. Method for manufacturing liners for internal combustion engines made of an aluminum alloy with a hypereutectic amount of silicon in the aluminum alloy,, characterized in that an aluminum alloy with a hypereutectic amount of silicon in the aluminum alloy melt is deposited by spray compacting onto a rotating support pipe such that there is generated directly a thick-walled pipe of a wall thickness of from 6 to 20 mm of aluminum alloy material with a hydereutectic amount of silicon in the aluminum alloy material, wherein the contained primary silicon particles have a size of from 0.5 to 20 $\mu$m, said thick-walled pipe, in case of need for coarsening the contained primary silicon particles, is subjected to an overaging annealing, wherein the primary silicon particles grow to a size of 2 to 30 $\mu$m, said pipe is reduced by a hot deformation process at temperatures of from 250 to 500° C. to a wall thickness of 1.5 to 5 mm.

19. The method for manufacturing liners according to claim 18 wherein the contained primary silicon particles have a size of from 1 to 10 $\mu$m.

20. The method according to claim 1, further comprising cutting said reduced thick-walled pipe into a cylinder liner.

* * * * *